United States Patent [19]

Mullen

[11] 4,077,296

[45] Mar. 7, 1978

[54] TONE CONTROL AND TUNING APPARATUS FOR A STRINGED INSTRUMENT

[76] Inventor: Delmar Eugene Mullen, 7061 Newport St., Commerce City, Colo. 80022

[21] Appl. No.: 654,841

[22] Filed: Feb. 3, 1976

[51] Int. Cl.[2] ..... G10D 3/14

[52] U.S. Cl. ..... 84/312 P; 74/526

[58] Field of Search ..... 84/312; 74/526

[56] References Cited

U.S. PATENT DOCUMENTS

| | | | |
|---|---|---|---|
| 3,136,198 | 6/1964 | Smith et al. | 84/312 |
| 3,352,188 | 11/1967 | Fender | 84/312 |
| 3,390,600 | 7/1968 | Kelley | 84/312 |
| 3,688,631 | 9/1972 | Jackson | 84/312 |
| 3,748,943 | 7/1973 | Lashley | 84/312 |

*Primary Examiner*—Lawrence R. Franklin
*Attorney, Agent, or Firm*—John R. Ley

[57] ABSTRACT

A transforming means in a tone changer device for transforming an amount of translational movement of an actuator means to a different or lesser amount of movement to be applied to a rotatable bar member dependently connected for pivoting a pivotable member whereby the tension in a string attached to the pivotable member is varied. A translational movement apparatus connected by control rods to the actuator means may supply approximately equal amounts of movement for increasing or for decreasing the tension in the strings. The translational movement apparatus may comprise a rocking arm and a parallel connected stabilizing rocking arm connected to a supporting member whereby pivoting the arms causes the supporting member to supply approximately the same amount of longitudinal movement for use by control rods. Tuners transfer the longitudinal movement from the translational movement means to the control rods. Each tuner comprises two stop members and a means between one of the stop members and the control rod for resisting relative movement therebetween to maintain the fine tuning of the tone produced when the tension is changed. A means for preventing relative rotational movement between a portion of the translational movement means and one of the stop members allows the tuner to be effectively used to adjust the fine tuning under conditions of tension change.

32 Claims, 9 Drawing Figures

TONE CONTROL AND TUNING APPARATUS FOR A STRINGED INSTRUMENT

BACKGROUND AND SUMMARY OF THE INVENTION

This invention relates to stringed musical instruments, and more particularly to apparatus for varying the tension in one or more of the strings and for tuning the strings of a stringed instrument of the type providing selective increases and decreases in the tension or tone of individual strings of the instrument, such as a steel guitar.

Playing a steel guitar is a relatively involved task. The instrument is played by moving a metal bar or "steel" along the strings to vary their effective length while plucking certain strings to produce the desired tone or chord. Variations of this technique are common to playing most stringed instruments, but additionally, with steel guitars the tension of one or more of the strings may be selectively increased or decreased from a normal level. Tension changes are controlled through foot pedals or knee pedals which the musician selectively operates singularly or in combination to achieve the different tensions or pitches from tone to tone and chord to chord throughout a musical composition. To play the instrument correctly, the musician must remember the manner in which the tension of one or more of the strings is changed by depression of each of the foot and knee pedals while moving the steel to vary the effective length of the string and choosing the correct string or strings to pluck. Although difficult to master and complicated to play, a skilled musician can produce a unique and interesting variety of sounds from a steel guitar, which partially accounts for the popularity of the instrument in certain musical groups.

It can readily be understood that apparatus for a stringed instrument of the steel guitar type which simplifies the tasks required of the musician and enhances the skill of the musician is of significant importance, and it is a general objective of this invention to provide such apparatus. Other objectives of this invention relate to improving the control over the tone changes produced by operation of the pedals, the ease by which the pedals may be operated, the arrangement of the apparatus to secure the tone changes desired, the tuning of the tone when the tension in a string is varied, and the assembly of the instrument.

The invention itself involves, in one embodiment, transforming means in a tone changer of the type having a pivotable member connected to each string for varying the string tension when pivoted as a result of rotation of a bar member operatively connected to the pivotable member. An actuator means and other associated apparatus selectively operated by the musician operatively causes rotation of the bar member, and operatively interposed between the actuator means and the bar member to secure one condition of rotation of the bar member is the transforming means for transforming an amount of translational movement of the actuator means to a different or lesser amount of movement applied to rotate the bar member. The transforming means may also apply a greater force on the bar member than that force applied by the actuator means, apply an increasing incremental movement to the bar member in relation to increasing movement of the actuator means, and cause the approximate same increase in tension as a resulting decrease in tension for approximately the same amounts of movement of the actuator means. A translational movement means includes means for supplying approximately equal amounts of movement for use by the control rods connected with the actuator means for increasing and for decreasing the tension of the strings. A tuner transfers movement from the translational movement means to the control rod and is used for fine tuning the tone or tension change. The tuner may comprise two stop members and a means for resisting relative movement between the control rod and one stop member whereby the stop members are prevented from moving due to naturally occurring forces. The tuner may also include means for holding one of the stop members or preventing relative rotational movement of one of the stop members when fine tuning the amount of tone or tension change.

A more complete description of one embodiment of the invention and its objects and advantages may be found in the following detailed description of the invention and brief description of the drawings.

A DETAILED DESCRIPTION OF THE INVENTION

Figure 1:
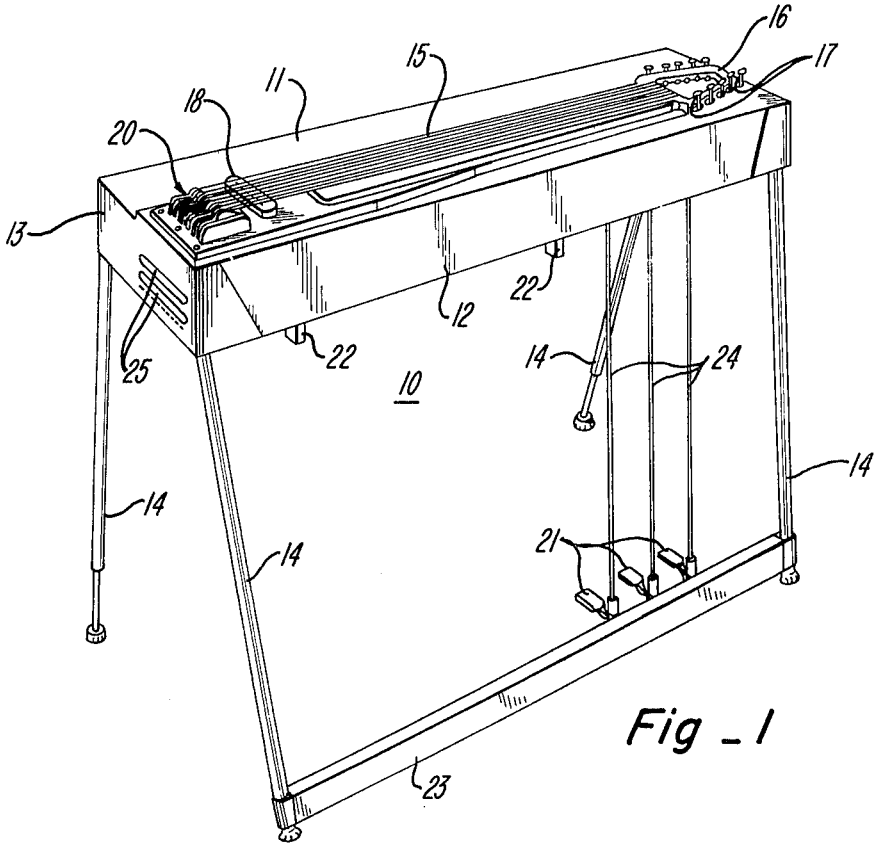
FIG. 1 is a perspective view of a stringed instrument such as a steel guitar to which the present invention relates.
Figure 2:
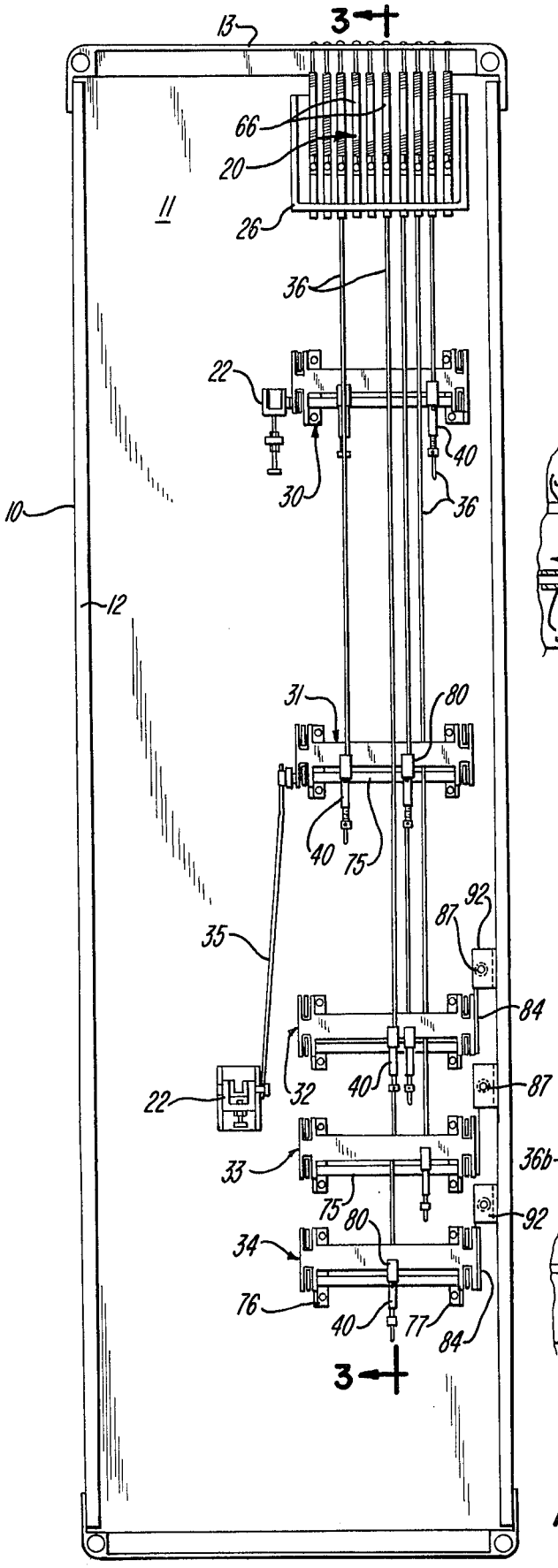
FIG. 2 is a bottom view of a major portion of the instrument of FIG. 1.

A general description of the arrangement and operation of a typical stringed instrument 10, such as an electric steel guitar, to which the present invention may be applied is directed toward FIGS. 1 and 2. In FIG. 1 a rectangular frame member 11 having downward extending sides 12 and ends 13 houses and supports various apparatus employed in the instrument 10. The frame member 11 is supported by removable legs 14 at a level convenient for playing by the musician. The instrument of FIG. 1 is of the single neck type because it provides only a single group 15 of a plurality of strings. As is known in the art, electric steel guitars having two groups of pluralities of strings are known as double neck instruments. Typically with double neck guitars one group of strings is supported on the frame member in a generally parallel and elevated relation with the other group of strings. Each group of strings may comprise as many as fourteen strings, but the single group 15 illustrated is comprised of only 10 strings. It should be understood that the present invention is applicable to stringed instruments of the single, double or multiple neck type.

Each of the strings in the group 15 extend longitudinally along the instrument and are retained at one end by a conventional tone adjustment means 16, which includes a plurality of individual tuning keys 17, each of which has one string attached in the usual manner. Rotation of each tuning key allows the musician to tune each of the strings to a desired tone or pitch by adjusting the normal tension in each string. With double neck instruments each neck may be separately adjusted to a different tuning so that the musician may select the tuning of one or the other of the necks that is the most advantageous for playing a particular musical composition. An electromagnetic or inductive pickup device 18 is mounted on the frame member 11 beneath the strings. The pickup device 18 senses the vibrations of the strings and transforms the vibrations into electrical signals to be supplied to an amplifier. Speakers connected with the amplifier reproduce the tones or the vibrations of the strings at an amplified level. The pickup device, amplifier and speakers are necessary because the natural tones of the vibrating strings of the typical steel guitar are barely audible. The necessity for electric amplifying devices causes an instrument such as that shown to be termed an electric steel guitar.

The other end of each of the strings of the group 15 is attached to a tone changer 20 at the end of the instrument longitudinally opposite the tone adjustment means 16. The tone charger 20 also includes components which extend below the top of the frame member 11 and which are operatively connected with an actuator means for causing the tone changer to operate. The sides 12 and 13 conceal the apparatus below the top of the frame member 11. Generally it is the function of the tone changer 20 to produce the selective tension variations in the strings under control by the musician.

Operatively connected with the actuator means are a plurality of control pedals which may include foot pedals 21 and knee pedals 22. The foot pedals 21 are suspended from a member 23 extending between two legs 14, and the foot pedals 21 connect with the actuator means by foot pedal rods 24. The knee pedals 22 are supported by and hand downwardly from the frame member 11 at positions convenient for operation by the musician's knees without impeding the musician's access to the foot pedals. Upon selective operation of one or more of the pedals by the musician, apparatus associated with the actuator means causes the tone changer 20 to vary the tension in one or more of the strings from the normal level of tension set by the tone adjustment means 16. The tension of one or more of the strings may increase or decrease depending on the manner in which the musician has set up or arranged the instrument, as will become more apparent from the subsequent description. Openings 25 in the end 13 adjacent the tone changer 20 are provided for the insertion of a tool for fine tuning the tone of those strings whose tension has been varied under conditions of operation of the tone changer.

Among other things FIG. 2 better illustrates the relationship of apparatus associated with the actuator means and the tone changer in a view toward the open bottom of the instrument 10. A housing 26 for the tone changer is attached to the bottom of the frame member 11 and contains a major portion of the elements of the tone changer. A desired number of translational movement means or apparatus, each individually referenced at 30, 31, 32, 33 and 34, are attached to the frame member 11 at different longitudinal positions extending away from the tone changer 20. Each of the translational movement means 30-34 may be of the same general construction, although the translational movement means 32, 33 and 34 are shown as operatively connected to the foot pedals 21 and the translational movement means 30 and 31 are shown as operatively connected to the knee pedals 22. One knee pedal may be directly attached to the translational movement means 30, while a rod 35 links the translational movement means 31 to its associated knee pedal.

A plurality of control rods 36 extend longitudinally from the tone changer 20 along the instrument to the translational movement means 30-34. When one or more of the pedals is operated, the translational movement means 30–34 produce a movement away from the tone changer 20 (to the left as is shown in FIG. 2) and some or all of the longitudinal movement is transferred to the control rods by tuners 40 selectively attached to each control rod. The longitudinal movement of the control rods causes the tone changer to increase or decrease the tension of those strings controlled by the control rods experiencing longitudinal movement.

The tuners 40 may be selectively attached along each control rod to transfer movement from as many translational movement means as is desired. For example, operation of the translational movement means 30 may decrease the tension of one string a given amount and the operation of the translational movement means 31 may move the same control rod to decrease the tension a greater or lesser amount. As will become apparent two control rods may extend from the tone changer for each string whose tension is to be varied, one control rod to cause an increase in tension and the other control rod to cause a decrease in tension. If the tension of any strings need not be varied, no control rods from the tone changer for those strings are necessary. If the tension of one string is to be varied in only one manner, for example to increase that tension, only one control rod is needed to control that string. In FIG. 2, control rods extend from the tone changer 20 for controlling only five of the ten strings connected to the tone changer, the remaining positions from which control rods could extend from the tone changer for controlling the other five strings are vacant. Thus, means for providing as many control rods as are necessary according to the control arrangement desired by the musician secure the tension variations desired.

It is apparent that a sufficiently wide frame member 11 will accommodate at least two separate tone changers and a corresponding number of separate sets of control rods 36. For example, in a double neck instrument, the translational movement means 30–34 may extend transversally of the instrument 10 a sufficient distance to encounter both sets of control rods from both tone changers, or separate translational movement means may be used for each set of control rods. Also certain pairs of the translational movement means may be operatively connected together to work simultaneously.

Figure 3:
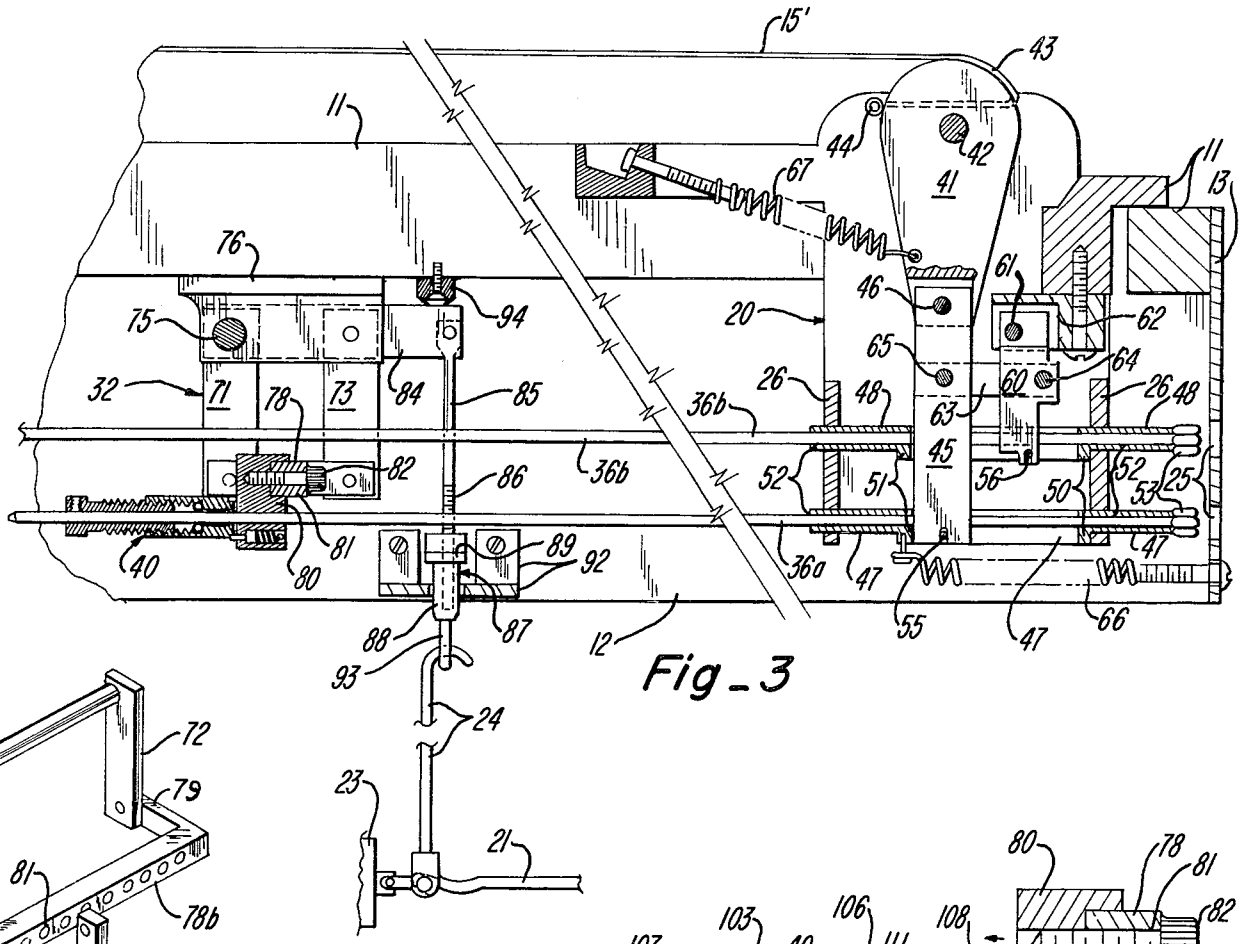
FIG. 3 is a fragmentary cross-sectional view taken along section 3—3 of FIG. 2 shown in an upright orientation which also includes certain other elements shown in FIG. 1.

Referring now to FIG. 3, a more complete understanding of one embodiment of the invention may be obtained. The tone changer 20 comprises a pivotable member 41 having an aperture formed therein for receiving a shaft 42 extending transversely of the tone changer housing 26. It should be understood that one pivotable member 41 is provided in the tone changer for each string of the group 15 attached to the tone changer, but for purposes of illustration, only one pivotable member 41 is illustrated attached to one string 15'. The arrangement and operation of the elements of each tone changer device for each string is similar to that illustrated and described. A semi-circular surface 43 concentric with the shaft 42 serves as a means for supporting the string 15' on the pivotable member. An enlarged end 44 of the string 15' is held by a means for anchoring the string which may be a hole bored longitudinally through the pivotable member 41 above the aperture for receiving the shaft 42. The string may be threaded from left to right as shown in FIG. 3 through the hole and placed over the semi-circular surface 43 and stretched to the tone adjustment means 16 for attachment to a tuning key. This arrangement provides easy access for attaching new strings to the pivotable member and prevents a broken string from falling into the other elements of the tone changer.

Tension variations in the string 15' are supplied by pivoting the pivotable member 41. If the member 41 pivots clockwise from its rest position shown in FIG. 3, the tension in the string 15' is increased, and if the member 41 pivots counterclockwise the tension is decreased. As the pivotable member 41 is pivoted about the shaft 42, the semi-circular surface 43 causes the length of the string 15' from the tone adjustment means 16 to the tone changer 20 to remain the same as the tension varies.

A rotatable bar member 45 is rotatably connected by a pinned connection 46 at its upper end to the pivotable member 41. Rotation of the bar member 45 in a clockwise direction from its rest position shown in FIG. 3 causes the pivotable member to pivot counterclockwise thereby decreasing the tension in the string. Rotation of the bar member 45 in a counterclockwise direction causes the pivotable member to pivot clockwise thereby increasing the tension in the string.

A lower slide member 47 is received by the tone changer housing 26, and an upper slide member 48 is disposed in a similar manner in the tone changer housing parallel to and vertically above the lower slide member. The slide members 47 and 48 are arranged for translational movement to an operative position to the left of the rest positions illustrated in FIG. 3. Shoulders 50 and 51 on the slide members 47 and 48 determine the rest positions and the maximum obtainable operative positions, respectively. Each slide member has a center bore 52 for receiving one control rod, and the lower slide member 47 receives a lower control rod 36a and the upper slide member 48 receives an upper control rod 36b. Heads 53 are rigidly attached to the end of each of the control rods and contact the slide members 47 and 48. Each head 53 is provided with a means for receiving a tool for rotating the control rod, an example of which may be a hexagonal shape of the head itself for receiving a socket wrench. As will be seen from the subsequent description, rotation of the control rods may cause a fine tuning of the tone when the tension is changed in the strings due to operation of the tuners 40.

A pin 55 rigidly attached to the lower slide member 47 provides a rotatable connection of the lower slide member to the bar member 45. A pin 56 rigidly attached to the upper slide member 48 provides a rotatable connection of the upper slide member to one end of a lever 60. The opposite end of the lever 60 is pivotably connected at a pinned connection point 61 to a stationary block member 62 which is rigidly attached to the frame member 11. A link 63 operatively connects the lever 60 with the bar member 45, and thereby forms a means for imparting movement from the lever 60 to the bar member 45. One end of the link 63 is rotatably pinned at connection 64 to a point on the lever 60 intermediate the points of connection at 56 and 61. The other end of the link is rotatably pinned to the bar member 45 at a connection point 65 intermediate the connection points at 46 and 55. The connection points 56, 61 and 64 along the lever 60 do not fall in a straight line, and consequently, the point 64 at which the link 63 is attached to the lever 60 is not colinear with a projection from the point of connection at 61 through the point of connection at 56 on the lever 60. The lever 60 and link 63 and the operative connection arrangement between the upper slide member 48 and the bar member 45 comprise a significant aspect of the present invention as will be better understood from the subsequent description of their operation.

A spring 66 attached between the lower slide member 47 and the end 13 of the frame member 11 biases the lower slide member to its rest position with its shoulder 50 against the tone changer housing 26. A spring 67 between the pivotable member 41 and the frame member 11 counteracts some of the normal tension in the string 15'. The excess tension in the string overcomes the bias force of spring 67 and forces the bar member toward a clockwise rotation around the connection pin 55. This clockwise rotational force exerted by the bar member 45 is transmitted through the link 63 and lever 60 to hold the upper slide member 48 in its rest position with its shoulder 50 against the tone changer housing 26. Screws connected with the springs 66 and 67 allow adjustment of the amount of bias provided by the springs, which should be that which retains one slide member in its rest position while the other slide member assumes its operative position.

It should be noted that in their rest positions, both slide members hold the pivotable member 41 in a stationary position. If it is desired not to vary the tension of any particular string, no control rods 36 need be inserted in the slide members, and the normal tension level set by the tone adjustment means 16 in that string is maintained. Similarly, when neither the upper nor the lower control rods are moved to the left, the elements of the tone changer maintain their rest position resulting in the normal tension level in the string 15' remaining unaffected. The effects of movement of each of the upper and lower control rods will be discussed in conjunction with FIGS. 4 and 5.

Figure 4:
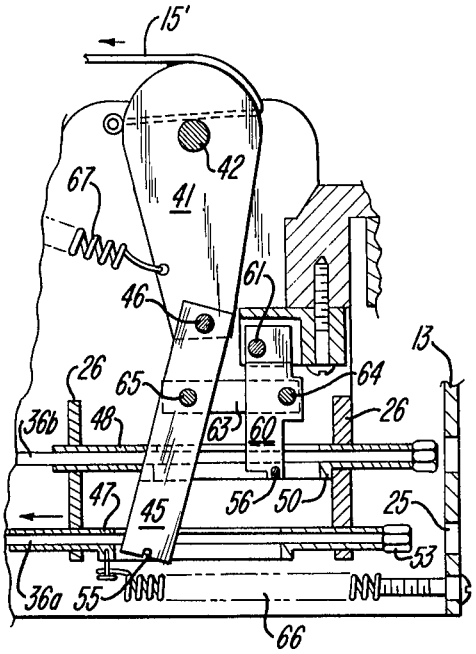
FIGS. 4 and 5 are diagrammatic views of certain elements of FIG. 3 illustrating two operative situations.

Reference to FIG. 4 is made for discussion of the operative relationships and positions of certain elements of the tone changer device when the lower control rod 36*a* has been longitudinally pulled or moved to the left by a translational movement means to thereby cause a decrease in the tension of the string 15'. The head 53 causes the longitudinal movement of the control rod 36*a* to translate the lower slide member 47 to the left to an operative position overcoming the bias force of spring 66. The pin 55 in the lower slide member moves the lower end of the bar member 45 to the left and causes the bar member to rotate about the connection point at 65. Rotation of the bar member about point 65 results because the tension of string 15', even in its decreased level shown in FIG. 4, is still effective to tend to rotate the pivotable member 41 counterclockwise and the force in this condition is applied through the bar member 45 to the link 63 and lever 60. The force on the lever holds the upper slide member 48 in its rest position with the shoulder 50 against the housing 26. Thus, when the bar member 45 experiences clockwise rotation due to the translational movement of the lower slide member 47, the upper slide member 48, the lever 60, and the link 63 maintain their rest positions and a rotational support for the bar member 45 is provided at the connection point 65. This operation decreases the tension in the string since one end of the string 15' moves slightly to the left due to the counterclockwise rotation of the pivotable member 41. The amount of movement of the lower control rod 36a is related to the tension decrease. Before describing the operation of the elements in conjunction with FIG. 5, it should be understood that the correct operation of the tone changer device will result only from movement of only one of the upper or lower control rods at a time to vary the tension of those strings.

Figure 5:
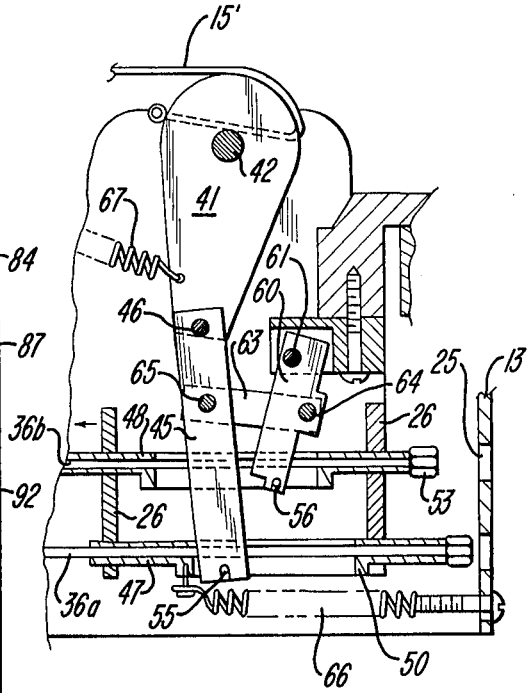

Reference to FIG. 5 is made for discussion of the operative relationships and positions of certain elements of the tone changer device when the tension in the string 15' is increased from its normal preset level. This result is achieved by the longitudinal movement of the upper control rod **36*b* and head 53 causing the upper slide member 48 to move to an operative position to the left of its rest position. Movement of the upper slide member 48 to an operative position is transformed by the lever 60 and the link 63 and applied to the bar member 45. The bar member rotates counterclockwise thereby forcing the pivotable member to rotate clockwise and increase the tension in the string 15' by moving one end of the string slightly to the right. Leftward translational movement of the upper slide member 48 is applied through the pin 56 to the lever 60, causing the lever 60 to rotate clockwise about the connection point 61 and push the link 63 to the left. The link 63 may also be slightly rotated from its rest orientation as it moves left, but the major component of the movement of the link 63 is in a horizontal direction to the left. The movement of the link is applied to the bar member 45 at the connection point at 65 thereby causing the bar member to rotate counterclockwise. The bar member 45 rotates counterclockwise about pin 55 because the lower slide member 47 remains in its rest position with its shoulder 50 abutting the tone changer housing as a result of the bias force from spring 66. The pin 55 of the lower slide member 47** thus provides a rotational support for the bar member.

As a result of translational movement of the upper slide member 48, a lesser amount of movement is applied by the link 63 to the bar member 45. The transformation of a greater amount of movement to a lesser amount of movement is a result of the distance or radius of rotation between connection points at 61 and 56 being greater than the distance or radius of rotation between connection points at 61 and 64 on the lever 60. Inherently, the distance traveled by the pin 56 as lever 60 rotates is greater than the distance traveled by the connection point at 64. Thus, the lever and link comprise one embodiment of a means for transforming an amount of longitudinal movement of the control rod to a lesser amount of movement applied to the bar member.

The lever 60 also embodies one example of a means for producing a greater force on the bar member than that force applied from the control rod on the upper slide member. The force applied to the lever by the pin 56 operates over the distance between connection points at 56 and 61, but the force applied by the lever to the link 63 for rotating the bar member 45 operates over the distance between connection points at 61 and 64. Because the distance between connection points at 61 and 64 is less than the distance between the connection points at 56 and 61, a mechanical advantage results to increase the force applied to the bar member from that force received from the slide member.

To fully understand the advantages of the transforming means and the greater force producing means, it is worthwhile to contrast the present invention to the prior art. In the prior art, the upper slide member 48 is directly pinned to the bar member 45 at some point intermediate the connection points 46 and 55. To decrease the tension, the bar member 45 is rotated clockwise about that point of direct connection by movement of the lower slide member 47 to the left. To increase the tension, the upper slide member 48 is moved to the left to directly rotate the bar member counterclockwise about the pin 55. Note that in the prior art, the distance from the connection point 55 to that point of direct connection of the upper slide member to the bar member (intermediate connection points 46 and 55) is less than the distance between the connection points 46 and 55. In the arrangement, a given movement of the upper slide member 48 actually creates a greater amount of movement at the connection point 46 for pivoting the pivotable member 41. Typically in the prior art, the distance between the pin 55 and the point of direct connection is greater than the distance between the connection point 46 and the point of direct connection, so that movement of the lower slide member 47 to an operative position causes a reduction in movement applied to the pivotable member. As a result in the prior art arrangement, the musician is required to cause a greater longitudinal movement of the lower control rod **36*a* as compared to a smaller movement of the upper control rod 36*b* to achieve the same increase as decrease in tension of the string 15'. Furthermore, because the point of application of force from the upper slide member 48 to the bar member 45 is the direct connection point intermediate the connection points 46 and 55, a reduced force is available to pivot the pivotable member 41 to increase the string tension. This reduced force must overcome the already significant normal tension in the string 15'**, and consequently, a considerably greater force must be applied to overcome this force disadvantage as compared to the force required to decrease the tension. It is apparent in the prior art that the amount of movement required to increase the tension is much smaller than the amount of movement required to decrease the tension by the same amount, and considerably more force must be applied by the musician to increase the tension than to decrease the tension.

The provision by the transforming means of the present invention of supplying a lesser amount of movement to the bar member 45 for a greater amount of movement of the upper slide member 48 achieves significant advantages over the prior art. Note from FIG. 4 that the movement of the lower slide member 47 to decrease the tension inherently involves a reduction of movement applied to the bar member 45 because the distance between the connection points at 55 and 65 is greater than the distance between the connection points 46 and 65. The reduction of movement applied by the transforming means when increasing the tension is intended generally to compliment the inherent reduction resulting from a decrease in the string tension. The amount of transformed movement may be determined by varying the distances between the connection points at 56, 61 and 64 and the location point of the connection at 65 on the bar member so that the distance of travel of the upper slide member to increase the tension a certain amount will be approximately the same as the distance of travel of the lower slide member to decrease the tension by the same amount. Such equal movement can be important to the musician in becoming accustomed to consistant amounts of pedal travel to produce certain pitch changes. For example, the musician would expect to depress a pedal further to produce two pitch changes than to produce a single pitch change. But if one pedal must be depressed a greater amount to decrease the tone of a string than another pedal must be depressed to increase the tone of a string, this difference to produce the same pitch change can be difficult to become accustomed to. Also, if the musician has arranged his instrument to simultaneously increase the tone of one string and decrease the tone of another string by the same amounts, then the same amount of movement of the control rods 36*a* and 36*b* by one translational movement means will achieve this result with the present invention.

A further consequence and advantage of increasing the amount of longitudinal movement of the upper slide member for a given amount of tension increase is to allow the tone when the tension is changed to be more finely tuned. As will be more fully explained subsequently, the fine tuning is secured by adjusting the amount of longitudinal movement imparted by the translational movement means 30–34 to a control rod 36 through a tuner 40. Fine adjustments in the amount of longitudinal movement by the tuner are further reduced by the effect of the transforming means to secure a finer resolution of the tone increase. In the prior art, fine tuning resolution is more difficult because the adjustments are increased in effect by the increased movement effect caused by the direct connection of the upper slide member to the bar member.

The mechanical advantage or increase in force supplied by the means for producing a greater force is significant. Increasing the tension of a string over its preset level can be somwhat burdensome, especially when a string whose tension is to be increased is tuned with a relatively high normal tension. The greater force producing means more easily allows the musician to increase the tension in a string and to do so with an effort more nearly the same as the effort involved in decreasing the string tension. The prior art typically provides a force reduction for increasing the tension, as explained, and the musician must compensate for the force reduction by increasing the effort exerted on the pedals. With the present invention, the musician may more easily control the instrument.

Another feature of the lever 60 is the non-colinear alignment of the connection points at 56, 61 and 64. The non-coliner alignment in conjunction with the lever 60 provides one embodiment of a means for delivering an increasing incremental movement to the bar member in relation to increasing movement of the upper slide member 48. Note that when the lever 60 rotates clockwise, the movement applied to the link 63 at the connection point at 64 is a result of rotation of the connection point 64 about the connection point at 61. When the lever 60 starts to rotate from its rest position, the movement at point 64 will be in an arc around point 61, and the arcuate movement will have both vertical (downward) and horizontal (leftward) components (FIGS. 3, 4 and 5). As the amount of clockwise rotation of the lever 60 increases, the horizontal component of the movement of pin 64 incrementally increases as the vertical component incrementally decreases. At the position when the point at 64 is directly vertically below the connection point 61, no vertical component exists since all the motion at point 64 is in the horizontal (leftward) direction. The incrementally increasing horizontal component of motion at connection point 64 is essentially what is transferred to the link 63 to cause rotation of the bar member 45, and the horizontal component of motion increases as the lever 60 rotates from its rest position to an operative position no further than a vertical alignment of points 61 and 64. The upper slide member 48 with the attached pin 56 causes rotation of the lever 60, so with movement of the upper slide member 48 increasing from its rest position, an increasing incremental movement is applied to the bar member 45. As a result, the tension change is increased more rapidly as a pedal is further depressed.

The means for delivering an increasing incremental movement is important to the convenience of the musician. Frequently the instrument will be arranged so one foot pedal will produce a tone change of one pitch in certain strings while an adjacent foot pedal will produce a tone change of, for example, two pitches. The musician may be required to alternately depress the two adjacent pedals frequently when playing one musical composition, or may even be required to depress both pedals simultaneously with one foot. Because the means for providing an increasing incremental movement causes more tone change with increasing pedal depression, the pedal causing a change of two pitches will not have to be depressed twice as far as a pedal causing a change of only one pitch. When the two pedals are simultaneously depressed with one foot, both pedals will travel more nearly the same distance thereby allowing the musician's foot to manipulate them more easily. This aspect of the invention conveniently causes a more uniform pedal depression in relation to the amount of tone change required, and allows the musician to become accustomed to more uniform amounts of pedal travel regardless of the tone change.

The foregoing advantages, conveniences and features make an instrument such as the steel guitar easier to play and to learn to play. The skill and proficiency of an experienced musician may be enhanced when using an instrument incorporating the present invention.

In the previously described embodiment of the invention, it should be understood that the translational movement supplied to the tone changer may be supplied by an actuator means. The actuator means as it relates to the the tone changer may generally include any element in the tone changer caused to move generally in a translational direction in response to selective operation by the musician, and in the specific embodiment illustrated and described, the actuator means may include one or both of the slide members.

Figure 6:
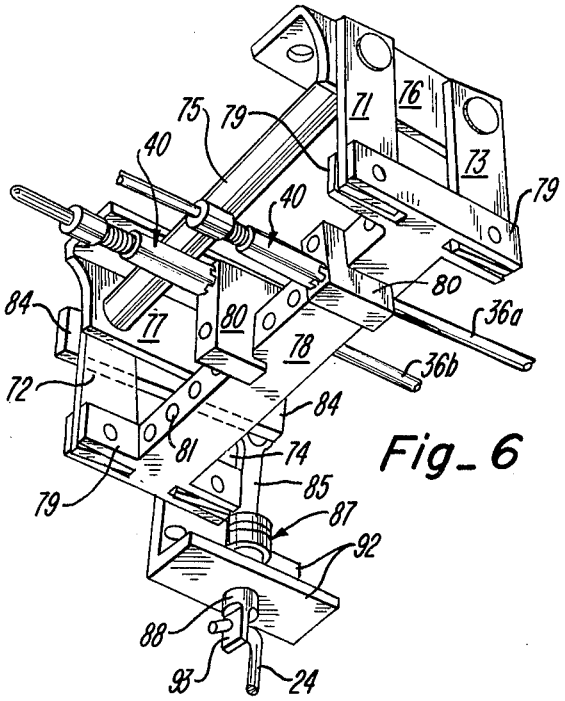
FIG. 6 is a perspective view of certain elements shown in FIGS. 2 and 3.

FIG. 6 illustrates a preferred embodiment of one of the translational movement means 32, 33 and 34. The translational movement means 30 and 31 operatively connected to a knee pedal are of the same general construction. The translational movement means are shown operatively connected to a lower control rod 36*a* and an upper control rod 36*b*, and it should be understood that the upper and lower control rods illustrated control the tensions in different strings since simultaneous longitudinal movement of both control rods to a single tone changer device for one string results in improper operation. Although one upper and one lower control rod are illustrated as operatively connected to the translational movement means, it should be understood that as many or as few control rods may be controlled by one translational movement means as is desired according to the preference of the musician. In an operative arrangement, each operative translational movement means is connected to at least one control rod. It is generally the function of the translational movement means to supply a longitudinal movement to any control rods operatively connected to that translational movement means by moving any connected upper and lower control rods in the same longitudinal direction along the instrument. Such movement, as previously described causes the tone charger to operate. The embodiment in FIG. 6 is particularly useful in combination with the tone changer 20 previously described because translational movement means illustrated includes means for supplying the approximate same amount of movement for use in moving each upper control rod as in moving each lower control rod. This same movement supplying means is particularly advantageous since the tone changer previously described may be arranged to produce approximately the same tension increase as decrease when the upper and lower control rods are moved approximately the same distance.

The translational movement means in FIG. 6 comprises a plurality of rocking arms 71, 72, 73 and 74. Rocking arms 71 and 72 are rigidly connected by a shaft 75 which extends through brackets 76 and 77. Apertures in brackets 76 and 77 allow the shaft 75 and the rocking arms 71 and 72 to be pivoted relative to the bracket. The brackets allow the translational movement means to be rigidly attached to the frame member 11 underneath the instrument 10 as is illustrated in FIG. 2 and may also comprise a means for pivotably connecting one end of each rocking arm to the instrument. The other ends of the rocking arms 71 and 72 are connected to a transversely extending supporting member or bar 78 which may include extensions 79 as a means for pivotably connecting the supporting member to the other end of each rocking arm. The rocking arms 73 and 74 may also function as stabilizing rocking arms. The stabilizing arms 73 and 74 are pivotably connected at one end to the brackets 76 and 77, respectively. The other ends of the stabilizing arms 73 and 74 are pivotably connected to the supporting bar 78 at the extensions 79. The points of connection of the arms 71–74 on the brackets 76 and 77 and the extensions 79 are arranged so that the arms are generally parallel to one another and the stabilizing rocking arms are longitudinally displaced from the rocking arms. The distances along each arm between its end connection points to the brackets and extensions should be approximately the same. The supporting bar 78 should be positioned at an approximate midway vertical position between the upper and lower control rods extending parallelly from the tone changer.

Figure 9:
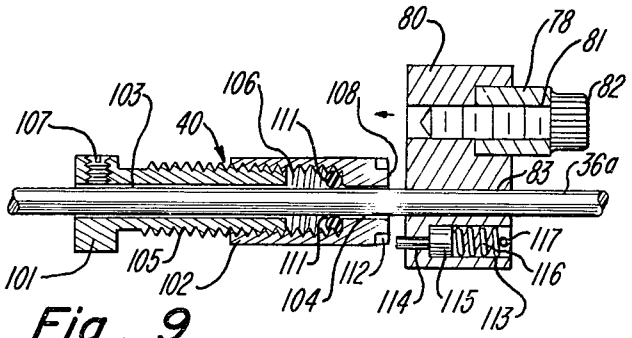
FIG. 9 is an enlarged cross-sectional view of certain elements shown in FIGS. 2, 3 and 6.

An abutment member 80 is attached to the supporting bar 78 as a means for delivering movement from the supporting bar to the control rods as is also shown in FIGS. 2, 3 and 9. A bore 81 extends longitudinally through the supporting bar 78, and a bolt 82 and a threaded bore in the abutment member for receiving the bolt 82 function as a means for providing a selective attachment of the abutment member to the bore of the supporting bar, as is best shown in FIG. 9. An opening or bore 83 (FIGS. 3 and 9) in each abutment member receives a control rod extending from the tone changer 20, and a tuner 40 is connected to the control rod adjacent the abutment member 80. The bores 81 are generally spaced at the same separation distance on the supporting bar 78 as the separation distance of the control rods from the tone changer. Only those abutment members 80 which are intended to deliver movement to the control rods are used to support the control rods. Since only one abutment member can be attached at a bore 81 to deliver movement to either the upper or the lower control rod, operation of one translational movement means will move only the upper or the lower control rod for each string to thereby insure proper operation of the tone changer device.

Means for pivoting the rocking arms and operating the translational movement means of the type operatively connected with a foot pedal 21 may include an arm 84 rigidly attached to the shaft 75 or to one of the rocking arms. A connecting rod 85 has one end rotatably connected to the arm 84 and has threads formed on the other end 86. A plunger 87, best shown in FIG. 3, has a threaded bore for receiving the threaded end 86 of the connecting rod 85. The plunger 87 has a generally cylindrical outer surface 88 and a shoulder 89 extending from the cylindrical surface 88. The cylindrical surface 88 of the plunger 87 is recieved in a round aperture in a bracket member 92 which may be attached to the side 12 adjacent a bottom portion of the instrument 10. A flat extension 93 projecting downward from a plunger includes a hole as a means for connecting the foot pedal rod 24. Rotation of the plunger by gripping the extension 93 determines the amount of relative length of the connecting rod 85 and the plunger. A rest member 94 of sound deadening material is attached to the frame 11 for cushioning the arm 84 when the translational movement means returns to a non-operative position shown in FIG. 3.

Means for pivoting the rocking arms and operating the translational movement means may also comprise apparatus operatively connecting a knee pedal 22 for rotating the shaft 75 or pivoting the rocking arms. Such apparatus is conventional and therefore not shown.

Figure 7:
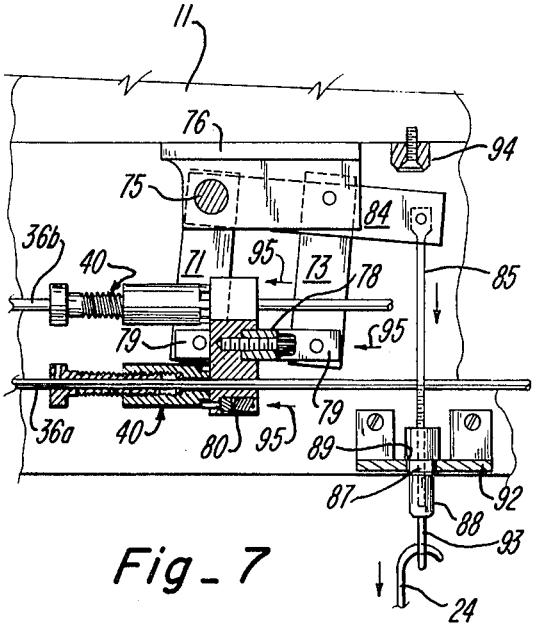
FIG. 7 is a diagrammatic side view of FIG. 6 and a portion of FIG. 3 illustrating an operative situation.

A description of operation of a translational movement means of the type illustrated in FIG. 6 may be had by reference to FIG. 7 wherein there is depicted a translational movement means in an operative position. The operative position results through depression of a foot pedal 21 which causes one foot pedal rod 24 to move downward until the shoulder 89 rests against the bracket 92 for limiting the extended movement of the plunger. The downward shifted movement of the connecting rod 85 causes the arm 84 to rotate the shaft 75. The rocking arms 71 and 72 rigidly attached to the shaft are pivoted clockwise which causes the supporting bar to move to the left and simultaneously pivot the stabilizing rocking arms 73 and 74 clockwise. Because the rocking and stabilizing arms have generally the same operative lengths and move parallel to one another, the extensions 79 from the supporting bar 78 are always maintained generally in a horizontal orientation or parallel to the brackets 76 and 77. Thus, the supporting arm 78 and abutment members 80 are maintained in the same rotational orientation during operation as when at rest and are prevented from rotating relative to a stationary reference. Notice that as the translational movement means operates, the supporting bar 78 has a major component of longitudinal movement 95. As the arms 71–74 pivot about their respective points of attachment to the brackets the supporting bar may experience a slight upward component of movement, but this component is perpendicular to the control rods and therefore does not affect them in operation.

The abutment members 80 attached rigidly to the supporting bar experience approximately the same longitudinal movement 95 in the operative direction as the supporting bar and also maintain the same rotational orientation during operation as when at rest. As a result, the movement which may be supplied by a translational movement means to each upper control rod **36*b* is generally the same as that movement which may be supplied to each lower control rod 36*a***.

The amount of longitudinal movement which may actually be transferred to the control rods depends on space between the tuner 40 and the abutment member 80 in the rest position as will be explained in conjunction with FIG. 9. If the tuner is touching the abutment member in the rest position, all of the longitudinal movement 95 will be transferred to the control rod. If the tuner is separated from the abutment member in the rest position, as is illustrated in FIG. 9, only a portion of the longitudinal movement 95 and the translational movement means is transferred to the control rod. In this manner, it may be that the amount of movement experienced by a control rod will vary depending on the point at which the abutment member contacts the tuner. It should also be noted that when one of a plurality of translational movement means may supply movement to a single control rod, as for example, the two translational movement means 32 and 34 which operate on the single control rod as is shown in FIG. 2, the operation of one of the translational movement means pulls the control rod freely through the bore 83 in the abutment member of the non-operative translational movement means. Simultaneously, the tuner associated with each non-operative translational movement means moves away from the abutment member and thereby does not effect the proper operation of the operative translational movement means. Although the foregoing description relates to a translational movement means operatively connected with a foot pedal 21, the same general construction, other than elements 84, 85, 87 and 92 may be readily adapted for use with a knee pedal 22.

It can readily be understood that the stabilizing rocking arms and the supporting bar and the abutment members provide one embodiment of a means for supplying the same amounts of movement for use by the upper and lower control rods. The stabilizing rocking arms may comprise a means for maintaining the supporting bar and abutment members in the same rotational orientation during operation as the supporting bar is moved in a desired direction.

The means by which the abutment members may be selectively attached to the supporting bars make the operative apparatus easy to arrange in the manner satisfactory to the musician. The abutment members need only to be attached to the translational movement means which move the control rods, thereby avoiding the necessity of and inconvenience associated with the use of supports along the control rods. The control rods may quickly be inserted through the slide members of the tone changer and extended to the translational movement means.

The arrangement including the plunger device 87, connecting rod 85, the bracket member 92 and the flat extension 93 facilitate easy assembly of the instrument. The foot pedal rods 24 must be attached to the instrument each time the instrument is assembled, but this is relatively easily accomplished because the flat extensions 93 extend slightly below the side 12 of the instrument, as seen in FIG. 2. By this arrangement, tedious manipulation of the foot pedal rods around and through the various mechanisms underneath the instrument for direct connection to an arm such as that at 84 is unnecessary, as is typical in the prior art. Furthermore the plunger device 87 and connecting rod 85 make coarse tuning of tension variations relatively easy. The maximum amount of operative longitudinal movement 95 of the translational movement means depends on the maximum amount of downward travel of the plunger device 87 before the shoulder 89 encounters the bracket 92. Rotation of the flat extension 93 readily adjusts the maximum amount of downward travel of the connecting rod 85 by controlling the amount of insertion of the connecting rod 85 in the threaded bore of the plunger device. The musician may thus easily adjust the coarse amount of tension variation in the strings by rotating the plunger device to limit the maximum extent of longitudinal movement 95 supplied by the translational movement means to the control rods. A means for finely adjusting the maximum extent of tone or tension change variations is provided by each tuner 40, as will be described subsequently.

Figure 8:
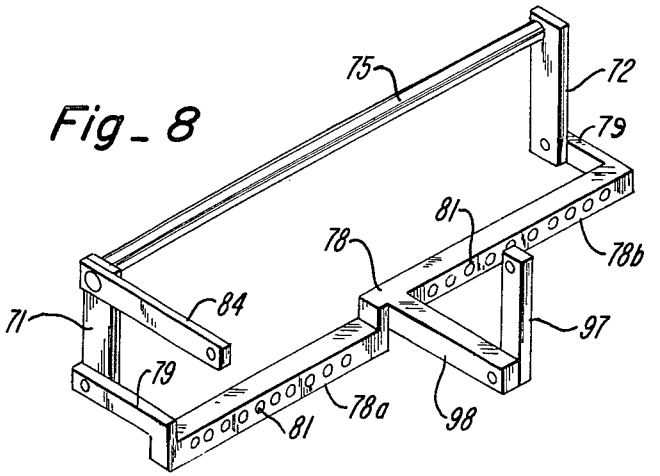
FIG. 8 is a perspective view of certain elements which may alternatively be incorporated in an apparatus such as that shown in FIG. 6.

An alternative embodiment of certain elements in a translational movement means is shown in FIG. 8. It may be that the two rocking arms functioning as stabilizing arms previously described, for example those at 73 and 74, are unneeded. The funtion supplied by the two stabilizing arms may be supplied by one stabilizing rocking arm, and in FIG. 8 a single rocking arm functions as a stabilizing rocking arm 97 and an extension 98 projects from the supporting bar 78 at a point intermediate the ends of the supporting bar to supply a means for pivotably connecting the arm 97 to the supporting bar. A bracket (not shown) serves as a means for connecting the upper end of the stabilizing rocking arm 97 to the frame 11 of the instrument so that the arms 71, 72 and 97 are parallel to one another and arm 97 is longitudinally displaced relative to arms 71 and 72. The distance along each arm between the pivotable connections on each of the arms is the same. This arrangement secures the same advantages as the embodiment previously described in conjunction with FIG. 6.

It may be desirable in a double neck instrument to have the translational movement means extend transversely the full distance across the frame member to encounter and supply movement to the control rods extending from the two tone changers. In such an arrangement it is typical that the elements of one neck of the instrument are located slightly above the elements of the other neck since one of the necks is slightly elevated from the other. As a result, the control rods of one neck lie in planes slightly above the control rods of the other neck. To ensure that the supporting bar 78 is in a position intermediate the control rods from each tone changer, the supporting bar may have two portions **78*a* and 78*b* which are vertically offset. Portion 78*a*, being vertically lower, will be intermediate the control rods from the tone changer of the lower neck. Portion 78*b* will be intermediate the control rods of the tone changer of the upper neck. Portions 78*a* and 78*b*** extend transversely at different elevations in a manner generally parallel to each other.

Another aspect of the present invention involves the tuner 40 generally described previously and now to be described in detail in conjunction with FIG. 9. The tuner comprises a first stop member 101 and a second stop member 102. The first stop member 101 has a central bore 103 which is relatively long compared to a shorter central bore 104 of the second stop member 102. The central bores receive a control rod, for example, the lower control rod 36*a* illustrated. The first stop member 101 has an externally threaded portion 105 concentric with its central bore 103, and the second stop member 102 has a bore for providing an internal threaded portion 106. The threaded portions 105 and 106 are complimentary to each other so that the two stop members may engage each other in a screw-like fashion, whereby rotation of one stop member relative to the other stop member adjusts the combined length of the stop members. A set screw 107 serves as a means for attaching one of the stop members, preferably the first stop member, to the control rod opposite the translational movement means shown in part by the abutment member 80. The other or second stop member extends from the first stop member toward the abutment member. A surface 108 of the second stop member serves to contact the abutment member 80 when the translational movement means moves to the left causing the abutment member to contact the second stop member. The threaded engagement of the first and second stop members and the rigid attachment of the first stop member by the set screw 107 to the control rod provides a rigid arrangement by which movement of the translational movement means is transferred to the control rod. The amount of movement which the control rod actually undergoes is only that amount of movement that the translational movement means imparts after contact has been made between the abutment member and second stop member at the surface 108. When the translational movement means is at rest, the separation distance between the abutment member and the surface 108 is related to the maximum amount of tone change provided by the operation of the movement means. If, for example, the translational movement means is to vary the tension in one string by two pitches and the tension in another string by one pitch, the separation distance between the abutment member and the tuner on the control rod providing the one pitch tension variation will be greater than the separation distance between the abutment member and the tuner on the control rod providing the two pitch tension variation. In this manner, the translational movement means may cause different amounts of tension change in different strings to achieve the tone effect desired by the musician.

A compressible member 111 is located in the bore of the threaded portion 106 of the second stop member 102. The compressible member 111 may be a rubber O-ring or some other member preferably made of solid resilient material. The compressible member 111 selected for use should have an outside diameter slightly larger than the bore of the threaded portion 106 of the second stop member and an inside diameter slightly smaller than the diameter of the control rod. When used as an element of the tuner, the compressible member is compressed when forced into the internally threaded bore of the second stop member and is compressed when forced over the control rod. In its compressed state, the compressible member 111 extends between the second stop member 102 and the control rod and the force resulting from compression resists any relative rotation between the second stop member and the control rod.

A compressible member comprises one embodiment of a means extending between one stop member and the control rod for contacting the control rod and for resisting relative movement between the control rod and that stop member. Recalling that the stop member 101 is rigidly attached to the control rod by the set screw 107, one result of the compressible member is a resistance to rotation of one member relative to the other stop member to resist changes in the combined length of the stop members. The means for resisting relative rotational movement is important in maintaining the fine tuning of the strings under tension change conditions. During playing of the instrument, the movements of the various elements and vibrations have a tendency to cause natural forces that may naturally cause one stop member to rotate relative to the other stop member. However, with the provision of the means for resisting relative movement the force between one of the stop members and the control rods is sufficient to resist rotation except when intentionally forced by the musician during a fine tuning operation, which will be described.

In one of the stop members, for example in the surface 108 of the second stop member, is a receptacle means which may comprise at least one notch 112. Preferably a plurality of notches 112 are provided with the notches being spaced the same distance from the control rod and being located at equal rotational positions. For example, six notches at equal radial positions around in the surface 108 may prove beneficial. In the abutment member 80, which contacts the surface 108 when the translational movement means is operated, is a bore having a large section 113 and a small section 114. A projection member 115 having large and small portions complimentary to the large section 113 and small section 114 of the bore fits within the bore of the abutment member. A spring means 116, held in the large section 113 of the bore by a pin 117, biases the projection member 115 to the left. The maximum extended position to the left of the projection member is defined and limited by the contact of the enlarged portion of the projection member with the small portion 114 of the bore in the abutment member. If the projection member experiences a force to the right, the spring means 116 will yield to allow the projection member 115 to move to the right to a retracted position where the small portion of the projection member is flush with the surface of the abutment member.

The small portion of the projection member 115 is located the same distance from the control rod as the notches 112 in the surface 108 of the stop member 102 are located from the control rod. Accordingly, when one of the notches 112 is aligned with the projection member and the abutment member contacts the surface 108, the small portion of the projection member 115 will project into and be received by the notch 112. When the projection member 115 is received by the notch 112 rotation of the stop member 102 relative to the abutment member 80 is impossible. When a plurality of notches 112 are provided in a second stop member, a plurality of rotational positions exist at which the projection member 115 may extend into a notch. Each of these positions defines a predetermined rotational alignment at which the projection member is received in a notch. If the predetermined rotational alignment does not exist when a translational movement means is moved to its operative position causing the abutment member to contact the surface 108 of the stop member 102, the spring means 116 allows retraction of the projection member to its retracted position. But should the stop member 102 be rotated to the predetermined rotational alignment, the spring means will bias the projection member to the extended position and it will be received in one notch 112 arranged for receiving the projection member in the extended position.

The foregoing notches 112 or receptacle means and the projection member may comprise one embodiment of a means for preventing relative rotational movement between the abutment member and one of the stop members. The projection member and a notch form a means for holding the stop member 102 in a stationery rotational position while the other stop member 101 may be rotated to adjust the combined length of the stop members and hence the maximum distance of travel of the control rods.

The operation of the tuner 40 in finely controlling the tone or tension change in the strings by determining the maximum amount of travel of the control rods will be discussed in relation to FIGS. 3 and 9. It will be recalled that the 52 bores in the slide members 47 and 48 of the tone changer 20 and the bores 83 and the abutment members are sufficiently large to not impede rotation of the control rods. The openings 25 in one end 13 of the instrument 10 allow the musician to insert a tool over the head 53 of the control rod for rotating the control rod. When the control rod is rotated, the first stop member rigidly attached to that control rod by the set screw 107 rotates with the control rod. To tune the tone or tension change, the translational movement means is operated to its operative position which causes the abutment member to contact the surface 108 of the second stop member 102. Until a predetermined rotational alignment exists, the projection member 115 is in a retracted position in the abutment member. As the control rod is rotated, the compressible means 111 causes the second stop member 102 to rotate with the control rod until a predetermined rotational alignment is achieved, at which point the projection member 115 extends into a notch 112 to rigidly hold the second stop member in a stationary rotational position. The first stop member 102 may be further intentionally rotated by the musician through rotation of the control rod to thereby adjust the combined length of the stop members and hence the maximum extent of the movement of the control rod. With the second stop member 102 being prevented from rotating, the resisting force exerted by the compressible means 111 is overcome by the intentional force of musician rotating the control rod. Rotation of the control rod in one direction or the other causes the first stop member and control rod to move to the right or left as its threaded portion 105 is screwed in or out of the threaded portion 106 of the stationarily held second stop member. Because the maximum operative position of the translational movement means has been previously limited to a coarse tuning position, the second stop member is also held in a stationary longitudinal position. The amount of this longitudinal movement controls the extent of variation of tension produced by the tone changer 20. A very fine resolution of the tone and tension change is available due to the very slight longitudinal movement of the control rod as a result of the screw action of the threaded portions of the stop members as they are rotated.

The fine tuning is accomplished after the coarse tuning has been determined. It may be that to secure proper fine tuning, the set screw 107 must be loosened and the position of the tuner 40 on each control rod must be adjusted. During normal playing of the instrument, the projection member 115 does not interfere with the fine tuning. The projection member will always retract when encountering the surface 108 of the second stop member if the predetermined rotational alignment does not exist, thereby allowing the abutment member to contact the surface 108; or if the predetermined rotational alignment exists, the projection member 115 will extend into the notch 112 and the abutment member 80 will still contact the surface 108 of the second stop member 102.

One advantage of the tuner is that the means between one of the stop members and the control rod for resisting relative movement avoids significant losses of fine tuning even after extended periods of use. The compressible means 111 which provides a significant force between one stop member and the control rod remains effective for long periods of time to maintain the fine tuning. Also the force of the compressible means is not between the two stop members, thereby avoiding a situation where a component of force between the two members is applied along the inclined slope of the threaded portions to encourage relative rotation between the stop members. The extension of the projection member into the notch effectively prevents rotational movement of the stop member, in contrast to some prior art arrangements employing a flexible spring tong to catch on the abutment member. Such spring tongs may easily bend, break or fail to catch. Furthermore, some prior art arrangements for tuners make the rotation of the control rod difficult when fine tuning the instrument. A contributing factor to this difficulty is the possibility that the stop member with the shorter central bore for receiving the control rod is rigidly attached to the control rod by the set screw. The shorter bore surrounding the control rod may allow the threaded portion of the stop member to be slightly misaligned and not concentric with the control rod, thereby making it difficult or impossible to screw the other stop member into the rigidly attached stop member or rotate one stop member relative to the other. With the present invention this problem may be avoided by attaching the first stop member 101 with the longer central bore 103 rigidly to the control rod, thus positioning its threaded portion 105 very concentrically with the control rod. The second stop member 102 having the shorter central bore 104 is retained to the control rod by the compressible means 111 which is somewhat flexible, and consequently the threaded portion of the second stop member may easily accommodate the threaded portion of the first stop member when rotated.

An illustrative embodiment of the present invention has been described fully to enable a clear understanding of the invention by the public after the term of the patent. It may be, however, that those skilled in the art will forsee changes and modifications from this detailed description, and it is therefore intended that the appended claims cover all such changes and modifications as fall within the true spirit and scope of the invention.

I claim as my invention:

1. A tuner for finely adjusting the maximum amount of longitudinal movement imparted to a rotatable control rod by a translational movement apparatus in a stringed instrument of the type having a tone changer for selectively varying the tension in one or more strings, comprising;

a first stop member having a threaded portion;

a second stop member having a threaded portion for engaging the threaded portion of the first stop member whereby the engaged length of the stop members may be varied by relative rotational movement of the stop members;

said stop members providing an aperture extending through their engaged length for receiving said control rod therethrough;

means for operatively rigidly attaching one of the stop members to the control rod of the stringed instrument; and means extending from the other stop member for contacting the control rod and for resisting relative rotational movement between the control rod and the other stop member, whereby changes in the engaged length of the stop members as a result of naturally-occurring relative rotational movement between the stop members when attached to the control rod is eliminated while the contacting and resisting means allows intentionally forced relative rotational movement between the stop members for adjusting their combined length.

2. A tuner as recited in claim 1 wherein the contacting and resisting means comprises a compressible member.

3. A tuner as recited in claim 2 wherein the compressible member includes solid resilient material.

4. A tuner as recited in claim 1 further including means for preventing relative rotational movement between a portion of the translational movement apparatus and one of the stop members.

5. A tuner as recited in claim 1 further including means for holding the other stop member in a stationary rotational position for allowing intentionally forced rotation of the stop member to be rigidly attached to the control rod.

6. A tuner as recited in claim 5 wherein the means for holding the other stop member comprises at least one receptacle means in the other stop member.

7. A tuner as recited in claim 6 further including a projection means for connection relative to the translational movement apparatus and for extending into the receptacle means when a predetermined rotational orientation of the other stop member exists.

8. A tuner as recited in claim 7 wherein:

the first stop member is intended to be rigidly attached to the control rod opposite the translational movement apparatus;

the second stop member has an internal bore for receiving the contacting and resisting means, extends from the first stop member toward a portion of the translational movement apparatus, and has a surface for contacting a portion of the translational movement apparatus;

each receptacle means comprises at least one notch formed in the surface for contacting a portion of the translational movement apparatus; and, the projection means is biased to extend into a notch when a predetermined rotational alignment of the second stop member exists.

9. A tuner as recited in claim 5 wherein:

both stop members have central bores defining said aperture for receiving the control rod, and the stop member to be rigidly attached to the control rod has a longer central bore than the other stop member.

10. A tone changer device for attachment to one end of a string of a stringed instrument for selectively varying the tension of the string, comprising:

a pivotable member including means for supporting and anchoring the string, said pivotable member being operative to increase and decrease the tension of the string when pivoted;

a rotatable bar member operatively connected at one end thereof to the pivotable member to pivot the pivotable member when rotated from a rest position;

a first slide actuator member positioned for translational displacement from a rest position, and operative upon translational displacement for rotating said bar member and pivoting said pivotable member to increase the tension of the string;

a second slide actuator member positioned for translational displacement from a rest position, said second slide actuator member being operatively connected to the other end of said rotatable bar member, and operative upon translational displacement for rotating said bar member and pivoting said pivotable member to decrease the tension of the string;

transforming means for transforming translational displacement of said first slide member into a predetermined amount of movement for rotating said bar member, the predetermined amount of movement being that movement for operatively pivoting said pivotable member approximately the same amount that said pivotable member is pivoted upon an approximate equal translational displacement of said second slide actuator member, said transforming means applying the predetermined amount of movement to said rotatable bar member at an effective point thereon substantially intermediate the operative end connections of said bar member to said pivotable member and to said second slide actuator member;

whereby said transforming means causes approximately the same increase in tension of the string for a translational displacement of the first slide actuator member as the decrease in tension of the string caused by the approximate same translational displacement of the second slide actuator member.

11. An invention as recited in claim 10 wherein in each tone changer device the first slide member is disposed generally parallel to and vertically above the second slide member, the first and second slide members thereby defining upper and lower slide members, respectively, and the invention further comprising:

means for providing an upper control rod extending longitudinally along the instrument and operatively connected for displacing the upper slide member to an operative position when moved in a desired longitudinal direction;

means for providing a lower control rod extending longitudinally along the instrument and operatively connected for displacing the lower slide member to an operative position when moved in the desired longitudinal direction; and, a translational movement means for moving the control rods in the desired longitudinal direction when operated, the translational movement means including means for supplying the approximate same amount of movement for use in moving each upper control rod as for use in moving each lower control rod.

12. An invention as recited in claim 11 wherein the means for supplying the approximate same amount of movement comprises:

a supporting bar extending transversely of the instrument and operatively connected to move in the desired longitudinal direction when the translational movement means is operated;

means in conjunction with the supporting bar for delivering movement from the supporting bar to the control rods; and, means for maintaining the supporting bar and the delivering means in the same rotational orientation as the supporting bar moves in the desired longitudinal direction;

whereby the amount of longitudinal movement supplied by the delivering means to the control rods is approximately the same as the amount of longitudinal movement of the supporting bar.

13. An invention as recited in claim 12 wherein the means for maintaining the same rotational orientation comprises:

at least one rocking arm pivotably connected to the instrument at one of its ends and operatively and pivotably connected to the supporting bar at the other of its ends;

at least one stabilizing rocking arm pivotably connected to the instrument at one of its ends and operatively and pivotably connected to the supporting bar at the other of its ends, each stabilizing arm being generally longitudinally displaced from and parallel to each rocking arm; and means operatively connected with at least one arm for pivoting the rocking and stabilizing arms to move the supporting bar in the desired direction;

whereby the parallel relationship of the rocking and stabilizing arms causes the supporting bar and delivering means to maintain the same rotational orientation as the pivoting of the arms moves the supporting bar longitudinally in the desired direction.

14. An invention as recited in claim 13 wherein the means for pivoting the rocking and stabilizing rocking arms further includes:

a connecting rod having a threaded end and being operatively connected to pivot the arm when shifted;

a plunger having a cylindrical surface, a shoulder extending from the cylindrical surface, a threaded bore for receiving the threaded end of the connecting rod, and means for connecting a pedal rod; and a bracket member having an aperture for receiving the cylindrical surface of the plunger and for limiting extended movement of the plunger at the shoulder, the bracket member being mounted adjacent a bottom portion of the instrument whereby to expose at least a portion of the means for connecting a pedal rod;

whereby the pluner may be rotated at the exposed portion to vary the relative length of the connecting rod and plunger to adjust the maximum amount of shift movement supplied by the plunger when extended.

15. An invention as recited in claim 12 further including a tuner selectively attached to a control rod to contact the delivering means for transferring longitudinal movement from the translational movement means to the control rod, the tuner comprising:

a first stop member having a threaded portion;

a second stop member having a threaded portion for engaging the threaded portion of the first member in a screw-like manner whereby the combined engaged length of the stop members may be varied;

means for rigidly attaching one of the stop members to the control rod; and, means between the other stop member and the control rod for resisting relative movement between the control rod and the other stop member, whereby naturally-occurring relative rotational movement between the stop members is eliminated.

16. An invention as recited in claim 15 wherein the means for resisting relative rotational movement between the control rod and the other stop member comprises a compressible member.

17. An invention as recited in claim 15 wherein:

the delivering means of the translational movement means comprises an abutment member rigidly attached to the supporting bar; and the tuner further includes means for preventing relative rotational movement between the abutment member and the other stop member.

18. An invention as recited in claim 17 wherein the means for preventing relative rotational movement between the abutment member and the other stop member includes:

a projection member having an extended position and a retracted position, the projection member being attached to extend between the abutment member and the other stop member;

at least one receptacle means for receiving the projection member in its extended position when a predetermined rotational alignment between the other stop member and the abutment member exists; and means for biasing the projection member to the extended position and for allowing retraction of the projection means when the predetermined rotational alignment does not exist.

19. A tone changer device as recited in claim 10 wherein the transforming means further includes means for applying increasing incremental amounts of movement to the bar member with increasing translational displacement of the first slide actuator member from its rest position.

20. A tone changer device as recited in claim 10 wherein the transforming means comprise:

a lever operatively connected at a first point to the first slide actuator member and pivotably connected at a second point opposite the first connection point to the instrument; and, means operatively connected between the bar member and a third point on the lever intermediate the first and second connection points for imparting movement from the lever to the bar member.

21. A tone changer device as recited in claim 20 wherein:

the means for imparting movement from the lever to the bar member comprises a link connected between the lever and the rotatable bar member; and the third point of connection of the link to the lever is not colinear with the first and second points of connection on the lever.

22. A translational movement apparatus for supplying movement in a desired longitudinal direction to at least one control rod connected to a tone changer in a stringed instrument, comprising:

at least one rocking arm, each rocking arm including means for pivotably connecting one end of the rocking arm to the instrument;

a supporting member includng means for delivering movement from the supporting member to at least one control rod and means for pivotably connecting the supporting member to the other end of each rocking arm;

means operatively connected to at least one rocking arm for pivoting each rocking arm and causing the supporting member to move in the desired longitudinal direction; and, maintaining means for maintaining the supporting member and the delivering means in the same rotational orientation when the supporting member moves in the desired longitudinal direction, said maintaining means operatively connecting the supporting member to the instrument independently of the control rod.

23. A translational movement apparatus as recited in claim 22 wherein:

the means for maintaining the same rotational orientation comprises at least one stabilizing rocking arm; and, the means for pivotably connecting the ends of each stabilizing rocking arm to the instrument and to the supporting member provide each stabilizing rocking arm in a relationship parallel to and longitudinally displaced from at least one other rocking arm;

whreby the parallel and longitudinally displaced relationship of the rocking arms cause the supporting member and the delivery means to maintain the same rotational orientation as the rocking arms pivot.

24. A translational movement apparatus as recited in claim 23 wherein the distances along the arms between the points of the pivotable connections on each end of each rocking arm are approximately the same.

25. A translational movement apparatus as recited in claim 24 wherein:

the supporting member comprises a supporting bar extending transversely of the direction of desired longitudinal movement;

one rocking arm is operatively attached to each end of the supporting bar; and, the means for pivotably connecting the supporting member to the other end of each rocking arm includes at least one extension projecting from the supporting bar longitudinally parallel to the desired direction for pivotably connecting the other end of a stabilizing rocking arm.

26. A translational movement apparatus as recited in claim 25 wherein:

two stabilizing rocking arms are provided; and, one extension from the supporting bar is provided for connection with each stabilizing rocking arm.

27. A translational movement apparatus as recited in claim 25 wherein the supporting bar is vertically offset to provide two parallel extending portions at different elevations.

28. A translational movement apparatus as recited in claim 25 wherein:

the supporting bar provides a plurality of attachment means;

the delivering means comprises at least one abutment member, and the invention further includes:

means for providing a selective attachment of the abutment member to the attachment means of the supporting bar.

29. A translational movement apparatus as recited in claim 25 further including:

a shaft rigidly connected between the two rocking arms operatively connected to the ends of the supporting bar, and wherein:

the means for pivoting the rocking arms is operatively attached to the shaft.

30. A tone changer device for attachment to one end of a string of a stringed instrument for selectively varying the tension of the string, comprising:

a pivotable member including means for supporting and anchoring the string;

a rotatable bar member operatively connected to the pivotable member to pivot the pivotable member when rotated from a rest position;

actuator means for producing translational movement for use in operatively rotating the bar member from its rest position; and means interconnecting the actuator means and the bar member for applying increasing incremental amounts of movement to the bar member with increasing movement of the actuator means from its rest position.

31. A tone changer device as recited in claim 30 wherein said means for applying increasing incremental amounts of movement to said bar member comprise:

a lever member operatively connected at one end thereof to said actuator means and pivotably connected at the other end thereof to the instrument; and means operatively connected from said bar member to said lever member intermediate the operative end connections of said lever member and said bar member for imparting movement from said lever member to the bar member.

32. A tone changer device as recited in claim 31 wherein:

said means for imparting movement from said lever member to said bar member comprises a link member pivotably connected at its opposite end between the lever member and the rotatable bar member; and the point of connection of the link member to the lever member is not colinear with the operative end connections to said lever member.

* * * * *